US005359750A

United States Patent [19]

Le Vantine

[11] Patent Number: 5,359,750

[45] Date of Patent: Nov. 1, 1994

[54] CONTROL DEVICE FOR FILM CLEANERS THAT REMOVE DUST, LINT AND STATIC CHARGE FROM FILM

[76] Inventor: Allan D. Le Vantine, 18225 Rancho St., Tarzana, Calif. 91356

[21] Appl. No.: 57,869

[22] Filed: May 7, 1993

Related U.S. Application Data

[62] Division of Ser. No. 920,646, Jul. 28, 1992, abandoned.

[51] Int. Cl.[5] ..... B08B 6/00

[52] U.S. Cl. ..... 15/319; 15/308; 15/1.51; 361/213

[58] Field of Search ..... 15/1.51, 308, 319; 355/30, 301; 134/57 R; 361/213

[56] References Cited

U.S. PATENT DOCUMENTS

| | | | |
|---|---|---|---|
| 3,395,042 | 7/1968 | Herbert | 15/308 |
| 3,852,793 | 12/1974 | McClintock | 134/57 R |
| 4,194,232 | 3/1980 | Cumming | 361/213 |
| 4,241,377 | 12/1980 | Cumming | 15/1.51 |
| 4,635,161 | 1/1981 | Le Vantine | 361/213 |
| 4,750,080 | 1/1988 | Cumming | 361/213 |
| 4,768,126 | 9/1988 | Le Vantine | 361/213 |
| 4,805,068 | 2/1989 | Cumming | 361/213 |

FOREIGN PATENT DOCUMENTS

| | | | |
|---|---|---|---|
| 488360 | 12/1929 | Germany | 15/308 |

*Primary Examiner*—David A. Scherbel
*Assistant Examiner*—Terrence R. Till

[57] ABSTRACT

A control device for use on film cleaners that remove dust, lint and static charge from plastic film surfaces by the use of high velocity ionized air. The high velocity ionized air removes static charge from the film simultaneously as the dust and lint are blown from the surface of the film by the convective action of the air. The control device is automatically activated when film is inserted between two sets of intersecting conductive fibers, thereby breaking the contact between the two sets of conductive fibers. In addition, the control device can be switched between a constant mode, where the air is on continuously, to a pulse mode where the air is pulsed alternately on and off, in a periodic manner, to synchronize the cleaning action with the stop and go advance of an automatic film printer system. The intersecting fibers also prevent the film from being drawn into the air inlets by the "Bernoulli Effect".

2 Claims, 2 Drawing Sheets

CONTROL DEVICE FOR FILM CLEANERS THAT REMOVE DUST, LINT AND STATIC CHARGE FROM FILM

This is a divisional of U.S. application 07/920,646 filed Jul. 28, 1992, now abandoned.

BACKGROUND OF INVENTION

1. Field of Invention

This invention relates to the removal of dust, lint and also static charge, simultaneously, from film. This is extremely important when making prints from photographic negatives. It is necessary to remove all dust and lint from the negatives so that a clean print can be made that is unblemished by the imaging of dust and lint adhering to the film. Static charge on film attracts dust and lint which is then bound to the film by the electrostatic attraction. Therefore, it is necessary to remove the static charge from the film in order to release the dust and lint and also to prevent it from being attracted back to the film after it is removed.

2. Description of Prior Art

Many methods have been devised to eliminate static charges from plastic film. The most common method is by making the surrounding air electrically charged or ionized both positively and negatively, thus allowing the charges on the film to be neutralized by contact with oppositely charged molecules of the adjacent air. However, other methods which remove the charge by conduction are used also. These include such methods as running conductive materials such as metallic or conductive brushes, wipers or conductive liquids over the surface, or by increasing the conductivity of the surrounding air such as by raising the humidity of the air.

Static charge on non-conductive plastic surfaces usually develops as the result of contact with another plastic item. Such plastic surfaces, or items in contact, have an atomic valence attractive force that holds them together. This force is electric in nature and is of the variety that holds materials together. Separation of these items results in a rending of some of the negatively charged electrons from one of the surfaces by the stronger attractive force of the other one, and the adherence of those electrons to that surface. Thus, the surface that has lost electrons is left with an electric charge to again attract negatively charged electrons, and has thereby acquired a positive charge. And, the surface which has gained a surplus of electron has thereby acquired a negative charge.

This is a classic example of how static charges develop. However, static charges are known to develop in many ways and on many surfaces and bodies that do not fit the above example. Static charges are transferrable through conductive means such as in a Van de Graff generator, or by accumulation of charge on an electrically isolated body through friction means, such as an aircraft or car by friction with the passing air. Charges can also be accumulated from direct contact with high voltage sources or by transmission from a surrounding ionized atmosphere.

Except in a vacuum, static charges tend to dissipate or leak off through the conductivity of the surrounding atmosphere. The greater the conductivity of the atmosphere the faster the charge will leak off. In humid weather, the moisture in the air makes the air more conductive than in dry weather when there is little moisture in the air. Thus, we seldom encounter static charge on a humid day and frequently encounter it on a dry day.

Static charges are transferrable. Static charge acquired by our clothing is transferred to our body or parts of our body. And, when we approach an object of different electrical potential (usually a ground potential), we experience an electrical discharge as electrons arc from our finger to that object, or vice versa. Static charge can also be transferred from our bodies to tools or other items we contact. These tools, in turn, can impart the charge to a voltage sensitive component causing damage.

Although an in-depth discussion of the principles of the many techniques for removing static charge a well as eliminating dust, lint and other particulate matter can be pursued, let us limit the range of this discussion to the immediate scope as defined by the application of the devices that will emanate from the subject invention.

This invention is concerned with devices for the removal of static charge, dust and lint by the use of a device that incorporates the blowing of ionized air over plastic film surfaces, and the control and augmentation of such devices. In such devices, air that is ionized both positively and negatively, so as to neutralize both positive and negative charges on the surfaces, is imparted with a sufficiently high velocity to convect the dust and lint off and away from these surfaces. The device also is configured to impinge on both surfaces of a typical plastic film, Thus, it incorporates structures to direct the air simultaneously to the opposing surfaces. The configuration embodies two parallel structures, usually referred to as jaws, between which the film is passed. The device is normally inactive until the film is inserted between the jaws. At that time a mechanism means automatically activates the device.

Devices of this design have been in existence for several years. They are referred to an anti-static film cleaners. U.S. Pat. No. 4,194,232 James M. Cumming et al. and U.S. Pat. Nos. 4,750,080 and 4,805,068 Newell E. Cumming et al. describe two such devices, as does my earlier U.S. Pat. No. 4,635,161 which was later expanded by my U.S. Pat. No. 4,768,126. Although there are significant differences between Cummings devices and my own, they do have basically the same configuration, that of having two jaws between which the film is placed.

U.S. Pat. No. 4,194,232 incorporates compressed air escaping at high velocity through small holes directed toward the film from above and below and, although there is no claim for an activation means, the text describes the interruption of a light beam that transects the film path through the device. Interruption of this light beam by the presence of the film turns the system on.

U.S. Pat. No. 4,750,080 also incorporates compressed air, similar to that above, and claims four light beams (i.e. electro-magnetic beams), two on each side, the interruption of which initiates activation of the device.

U.S. Pat. No. 4,805,068 uses brushes instead of high velocity air which contact the film both top and bottom to remove the dust, while the device is activated by the interruption of light beams. However, there is no claim for the use of a light beam.

U.S. Pat. No. 4,635,161, which is my patent, is primarily a device for eliminating static charge, dust and lint from surfaces, including plastic film surfaces, and the configuration as a film cleaner is described in the text. However, being a basic patent for the invention of a device that uses constant DC high voltage for the elimination of static charge, no specific claims were made for a specific application. However, in practice some film cleaners manufactured under this patent do incorporate the interruption of a light beam to activate the device.

Although the initial devices manufactured under U.S. Pat. No. 4,635,161 incorporated the use of compressed air which was converted to a high velocity as it passed through small apertures, later models used the high speed impeller design claimed in my U.S. Pat. No. 4,768,126 to produce high velocity air for the removal of dust and lint as well as the static charge. Some of these devices also utilized the interruption of a light beam to activate the system.

There is another characteristic of all of the above discussed film cleaners that use high velocity air as a means of removing the dust and lint. That is the "Bernoulli Effect". When air flows from an opening and impinges on a flat surface spaced near and perpendicular to the opening, the air flow changes direction to follow the contour of the flat surface. As the air flows away from the opening, the pressure of the flowing air decreases, resulting in a lower air pressure in the region of the opening than that of the surrounding atmosphere. If the flat surface is a thin plastic film, such as that used in photography, the effect will be that the film will be acted upon by the greater atmospheric pressure and forced against the opening from which the air is flowing.

This is undesireable for photographic film, as the film can be scratched if there is any roughness to the surfaces near the air flow opening. To combat this effect, film cleaners using high velocity air used polished smooth surfaces in the area near the air openings to prevent scratching. However, this technique is not always satisfactory and scratches on film can occur as rough spots develop with use or foreign particulate matter accumulates.

SUMMARY OF THE INVENTION

Accordingly it is an objective of this invention to provide an improved method for activating electrically operated air blowing antistatic film cleaners.

It is also an objective to provide a means to prevent the scratching of film as the result of the Bernoulli effect forcing the film against one of the jaws of the film cleaners.

It is another object of this invention to present a means for causing the film cleaner to pulse on and off in a periodic manner to coincide with the frame by frame printing cycle of an automatic film printer.

The above and other objectives of the present invention are achieved according to the following aspects thereof.

The primary elements of this invention for activation of the film cleaner are tufts of very soft electrically conductive fibers. By "very soft" it is meant that these fibers will not scratch photographic film. One or more tufts project upward from the lower jaw of the film cleaners, and one or more tufts project downward from the upper jaw of the film cleaner. The tufts, upper lower, intersect in pairs. One upper tuft intersects one lower tuft.

The fibers of the tufts, being electrically conductive, can therefore carry an electrical signal from the upper jaw area to the lower jaw area. An electrical signal arising from a discriminating device can be used to determine when a film has been inserted between the jaws by the interruption of the continuity of the circuit through the tufts. Thus, when a film is inserted between the jaws of the film cleaner it separates the fibers of an upper and lower tuft pair, breaking the continuity of the electrical circuit and thus activating the system.

By the proper location and design, the fiber tufts serve to provide a counter force to oppose the force of the Bernoulli effect that draws the film against the jaws of the film cleaner. Although high velocity air enters the space between the jaws of the film cleaner at both the top and bottom, the film is drawn to the side to which it is closest. The force of the Bernoulli effect will cause the film to deflect the tufts, on that side. If the fibers of the tuft, cumulatively, have sufficient stiffness to reach some equalibrium point where their force is equal and opposite to the Bernoulli effect force, the forces above and below the film will be equal, an the film will be prevented from moving closer to and contacting the jaw of the film cleaner.

The force developed by the Bernoulli effect as well as those of the opposing deflection of the fibers can be calculated. Even though there are many variables, a mathematical relationship can be established that will provide a first cut approach to designing such a film location system. This relationship can be expressed by the following equations which were derived from the physical laws of gas flow and mechanical deflection.

The Bernoulli equation for pressure, $$P+0.5\rho v^2+\rho g\, y=\text{constant}$$

Where:

P=Pressure
$\rho$=Density
g=Gravitational constant
y=Height above reference
v=Velocity can be modified for this particular application with the elimination of the insignificant term, $\rho gy$, as follows:

$$F=\frac{\rho Q^2 A}{8\pi^2 r^2}\left(\frac{1}{h_2^2}-\frac{1}{h_1^2}\right)$$

Where:

Q=Volume air flow
r=Radius of air inlet
h=Distance from film to jaw surface
A=Area of film
$\pi$=The natural circle ratio
Subscripts refer to 1, upper jaw and 2, lower jaw.

The equation for the opposing force of a tuft of fibers can be derived as:

$$F=\frac{3\pi E D^4 X}{32\zeta^2 N}$$

Where:

E=Modulus of elasticity
D=Diameter of fiber
$\zeta$=Distance of end of fiber is bent from vertical
X=Deflection of fiber
N=Number of fibers in tuft Using these equations, where the distance between the jaws $(h_1+h_2)=0.4$ inches, and the air flow of 16 CFM, a tuft of approximately 2,000 nylon fibers, each measuring 0.002 inches in diameter, would support a film at 0.10 inches away from the jaw of the film cleaner.

The procedure for making photographic prints of long strips of film negatives on automatic printers involves first centering the frame in the aperture of the printer, initiating the process that exposes the positive, then positioning the next frame and so on. It takes about four seconds to move from one frame to the next. It is desireable to have the film threaded through the film cleaner immediately ahead of the printer to insure that the film will be free of dust, lint and static charge when it is printed.

With present state of the art automatic film cleaners, the film cleaner would turn on and continuously blow air as long as the film remains in the film cleaner. This is objectional as it results in the excessive use of compressed air, or the excessive wear on the high speed motors if the air is developed within the film cleaner. Therefore, it is impractical to put these film cleaners in line with the printer, as the entire strip of film is usually passed through the film cleaner before it is threaded into the printer.

It takes less than one second to clean and remove the charge from a frame of film. Therefore, if the film cleaner were in line with the printer it need be turned on for only one out of every four seconds that it takes to print a frame to keep the film clean as it feeds into the printer. This would greater increase the life of the film cleaner motors and lessen the drain on a compressor system.

This invention incorporates in the activation system of the film cleaner, a means for causing the film cleaner to turn on and off periodically to coincide with the printing speed of an automatic film printer, in a manner that provides a minimum but ample cleaning time with each advancing frame. This is accomplished by the intervention of electronic means into the activation circuits of the film cleaner. An adjustable means is also incorporated to provide proper synchronization with the speed of the printer.

It should be recognized that the embodiments of the invention as described above are only that which have been designed and tested. It should be apparent that there are many more embodiments that can be envisioned. However, the above does provide an adequate description of the invention.

BRIEF DESCRIPTION OF THE DRAWINGS

The above embodiments of the invention may be more fully understood from the following detailed descriptions taken together with the accompanying drawings wherein similar reference characters refer to similar elements throughout and in which.

DESCRIPTION OF PREFERRED EMBODIMENTS AND APPLICATIONS

The embodiments of the invention are envisioned but not limited to those described. It should be recognized that other designs can be used to accomplish the unique principles set forth here. Different techniques for fabricating or positioning the tufts of conductive fibers or different circuits that accomplish the same purpose can be envisioned. Moreover, the invention is not limited to the applications described.

Figure 1:
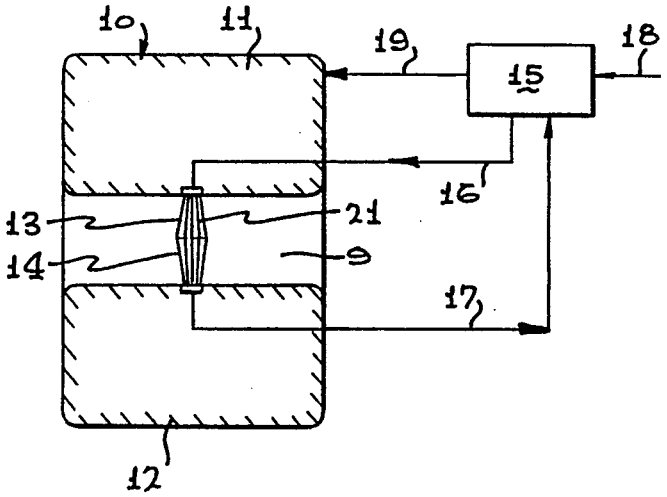
FIG. 1 is a diagram of a front view of the film cleaner showing the conductive fiber tufts and connecting circuitry.
Figure 2:
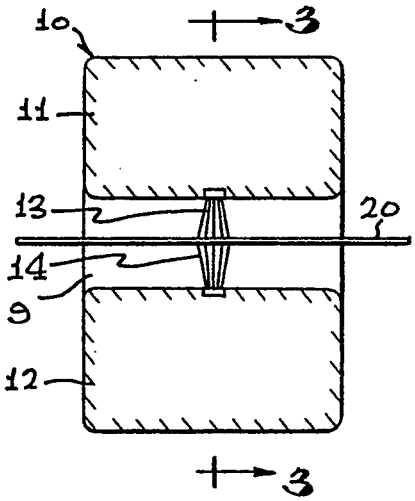
FIG. 2 is a diagram of a front view of the film cleaner with film inserted.
Figure 3:
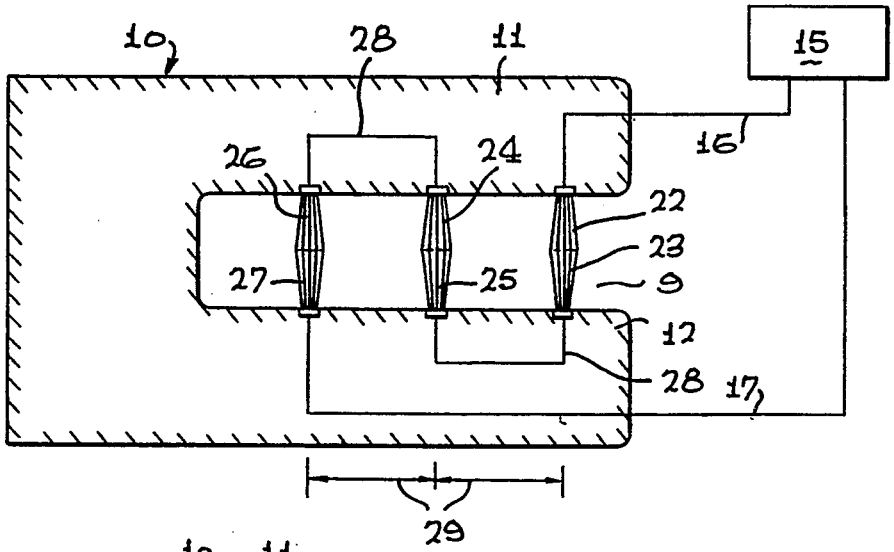
FIG. 3 is a sectional view along lines 3—3 of FIG. 2.

Referring to the figures, FIG. 1, 2, and 3 illustrate the first item of the embodiment of the invention. It is comprised of a film cleaner 10 with upper jaws 11 and lower jaws 12. The space between the jaws 9 has one or more sets of tufts 13 and 14 made up of conductive fibers 21. These fibers are sufficiently soft so that they will not scratch photographic film. Tufts 13 and 14 are of a specific length such that their free ends slightly overlap permitting the conductive fibers to contact each other. This contact provides an electrical conduction path from one tuft to the other. The tufts are connected electrically through conductors 16 and 17 to a discriminator circuit 15 which can determine electrically that there is a conduction path through the tufts. If the tufts are in contact the conduction path exists and if they are not in contact, the conduction path does not exist.

The discriminator circuit 15 controls the power to the film cleaner. When the circuit path through the tufts has continuity it sets the film cleaner to the off position. When the circuit path through the tufts is interrupted (open), the discriminator circuit turns the film cleaner on. This is illustrated in FIG. 2 where film 20 is inserted between the jaws of the film cleaner. The introduction of the film separates the fibers of the tufts, thus opening the circuit and interrupting the continuity to the discriminator and indicating that a film has been inserted into the film cleaner and the film cleaner is to be turned on.

Some film cleaners have a very deep space 9 between the jaws. Sometimes the film to be cleaned is very narrow so inserting it between the jaws will not cause it to separate just a single set of tufts. The accomodate this application, a multiplicity of tuft pairs 22 and 23, 24 and 25, and 26 and 27 are spaced apart as shown in FIG. 3. These tuft pairs are spaced apart a proper distance 29 so that the film will separate at least one set of tufts. The tuft pairs are wired in series by conductive links 28 and connected to discriminator 15 by conductive paths 16 and 17. Thus, when any one of the tuft pairs is separated by the intervention of a film, the conductive pathway to the discriminator is opened and the discriminator initiates the turning on of the film cleaner.

Figure 4:
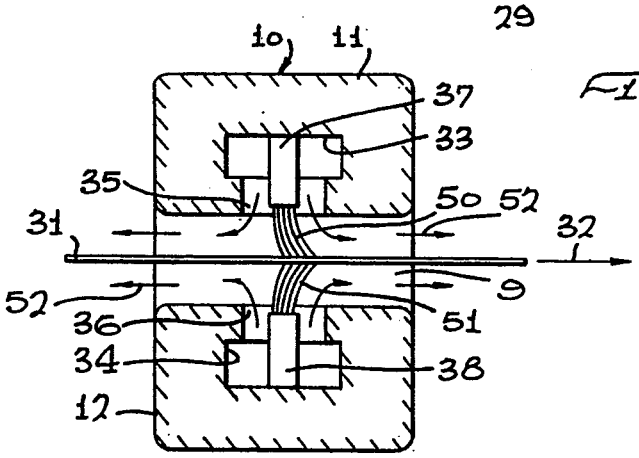
FIG. 4 is a sectional view across film cleaner with film passing therethrough.
Figure 5:
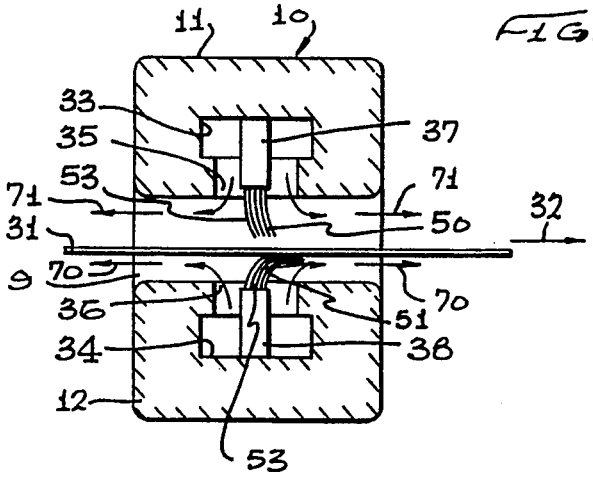
FIG. 5 is a sectional view across film cleaner showing deflection of lower tuft by film.

Referring to the figures, FIG. 4 and 5 illustrated the second item of the embodiment of the invention. It is comprised of fiber tufts 50 and 51. These tufts may or may not be the same fiber tufts 13 and 14 of FIG. 1 and 2. In FIG. 4 air enters the space between the jaws from upper air inlet 35 and lower air inlet 36. The velocity of this air is sufficiently high so that as it impacts on film 31 it will remove the dust and lint adhering to the surface of the film. The tufts 50 and 51 are mounted respectively on support pedastals 37 and 38. As the film moves through the film cleaner in the direction shown by arrow 32 it tends to drag by friction the tips of the tufts 50 and 51 causing them to bend in the direction of the motion of the film as shown in FIG. 4. The air flowing into the space 9 from inlets 35 and 36 flows generally in the directions indicated by arrows 52.

As the air flows out of the film cleaner, certain pressure instabilities develop that make it impossible for the film to remain in the exact center of the space between the jaws. These instabilities result from the Bernoulli Effect, which produces a lowering in pressure a as result of an increase in the velocity of the air flow. Thus, the film will tend to move toward the jaw where the velocity is greatest, as the pressure on the side will be lowest. Further, as the film moves closer to a particular jaw, the resulting reduction of the volume for the air to flow through on that side causes the velocity of the air on that side to increase. Hence the pressure on that side decrease further causing the film to appreciably be drawn even closer to that jaw. Ultimately the film will be drawn to and held against the inlet opening on that side.

FIG. 5 shows the film being drawn to the lower jaw by the Bernoulli Effect, and the velocity of the air below the film 70 is greater than the velocity of the air above the film 71. FIG. 5 also shows the tuft 51 deflected by the pressure from the film. The tufts 50 and 51 are made up of a multiplicity of fibers such that their cumulative stiffness will develop a force equal to and opposite the force of the film at a prescribed distance from either the upper or lower jaw, thus preventing the film from contacting the jaws of the film cleaner. In this particular design, the air flow from each inlet was 16 cubic feet per minute. The distance between the jaw was 0.4 inches. The tufts each were comprised of 2000 nylon fibers, each fiber measuring two thousandths of an inch in diameter. The equilibrium distance was 0.1 inches from the jaw. These values are in agreement with calculations made using the equations described earlier in this disclosure.

It should be apparent that a multiplicity of tufts may be used. These tufts, spaced apart within the confines between the jaws, are merely an extension of the above description.

Figure 6:
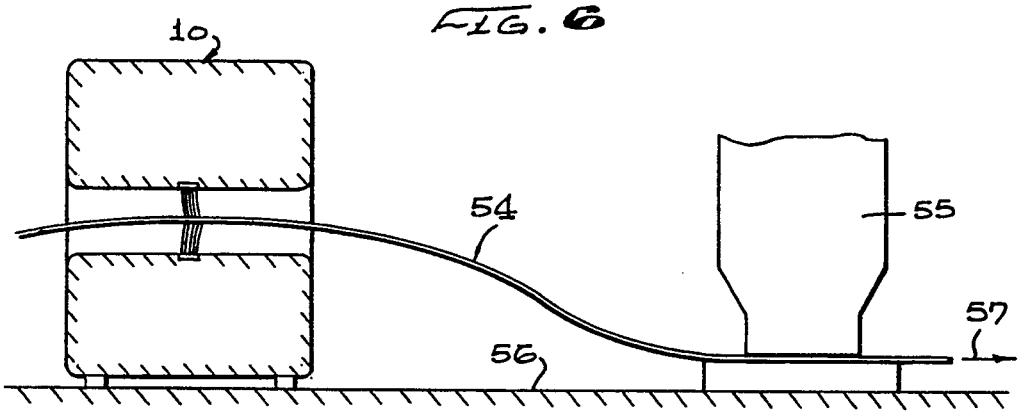
FIG. 6 is a view of the film cleaner on a film printer with film threaded through the film cleaner and the printer.
Figure 7:
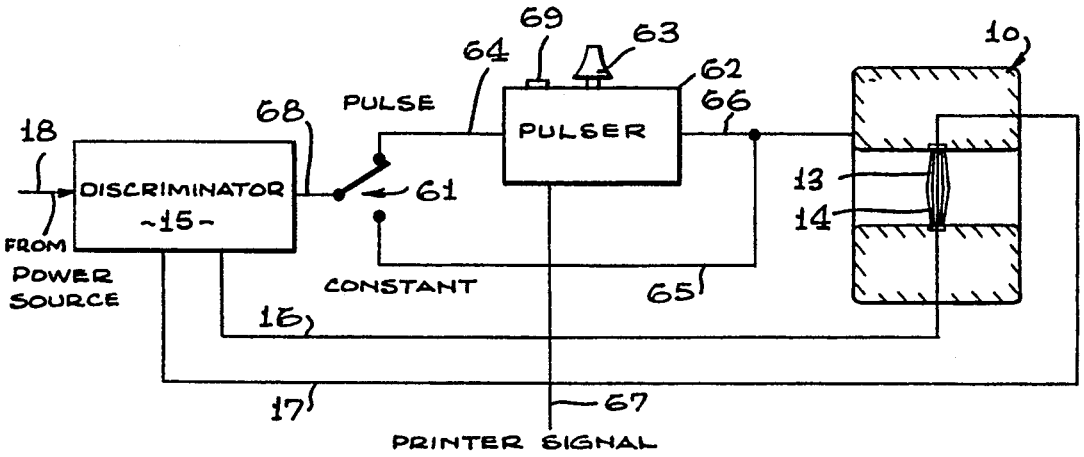
FIG. 7 is an electrical diagram of the film cleaner activation and pulse control circuit.

Referring to the figures, FIG. 6 and 7 illustrate the third item of the embodiment of this invention. FIG. 6 shows a long strip of film 54 threaded through the film cleaner 10 and then through the printer between printer head 55 and printer table 56. Film 54 is moving in direction 57 with a stop and go motion. The film stops with each frame centered in the printer while the printer projects the image of the film onto photosensitive paper to expose a print. When the exposure is complete the film moves to the next frame to expose a new section of paper which has replaced the previous exposed paper.

As the film moves in a stop and go manner, it is apparent that there is no ned for the film cleaner to be turned on during the period when the film is stopped. FIG. 7 is an electrical diagram of a mechanism means to control the on or off status of the film cleaner. Electric power from a power source is carried by conductor means 18 to discriminator circuit means 15. Discriminator means 15 is sensitive to the conduction path through the tufts 13 and 14 by conductor means 16 and 17. Discriminator means 15 determines whether or not there is a film separating the tufts. If film is present it provides continuity from the power source through conductor 68 to switch 61. Switch 61 has two positions. One position directs the power by conductor means 65 to film cleaner 10. This position of switch 61 is referred to as the "constant" position because the film cleaner turns on every time there is film separating the tufts. The other position of switch 61 is the "pulse" position, and when in that position the power is transmitted via conductor means 64 to pulser circuit means 62. Pulser circuit means 62 alternately turns the power, connected by conductor means 66 to film cleaner 10, on and off in a periodic manner.

The pulse circuit means is controlled to coincide with the advancement of the film such that the film cleaner is turned on when the printer advances the film and is turned off when the film is stopped. This is accomplished by either of two alternate means. The first alternate means is by a signal from the printer indicating that the film is moving, which is carried by conduction means 67 to pulser circuit means 61. The second alternate means is by a timing means incorporated within circuit means 62. Said timing means is adjustable by knob 63 as an integral part of circuit means 62. Knob 63 will adjust the timing so that the film cleaner will turn on and off with the same periodicity as the advance of the film. Further, synchronization button 69 is also integral with circuit means 62 such that when button 69 is depressed it will start a turn on cycle. Thus, button 69 can be used to synchronize the on and off sequence to coincide with that of the film motion by pressing the button at the beginning of the advance of the film. It should be noted that only one of the two alternate means would be used for a particular application of the invention.

While the principles of the invention are thus disclosed and the embodiments are described in detail, it is not intended that the invention should be limited by such. It should be recognized that many modifications will occur to those skilled in the art which underlies the scope of this invention and that the invention cover such modifications and be limited only by the appended claims.

What is claimed is:

1. In an electrically operated film cleaner for removing dust, lint and static charge from the film, used in conjunction with a film printer and located adjacent to a film entrance to the film printer such that the film passes through the film cleaner before entering the film printer, said film cleaner having an upper jaw and a lower jaw, and between which there is a space for inserting the film, a device to activate the film cleaner that turns said cleaner ON and OFF continuously in a regular periodic cycle when film is inserted into the space between the jaws and to deactivate the film cleaner to remain off when there is no film between the jaws comprising:

a discriminator means that detects the presence of film within the space between the jaws of the film cleaner and produces an output signal, a pulser means, connected by circuitry means to the discriminator means, which upon receiving a signal from the discriminator means, indicating the film is between the jaws of the film cleaner, operates the power to the film cleaner to cycle the film cleaner ON and OFF repeatedly at regular intervals of ON and regular intervals of OFF, said intervals of ON and OFF, each being set by separate adjustment means, to coincide with regular stop and go motion of the film printer as the printer stops the film to print each individual frame and then advances and stops the film to print each subsequent frame, in a repetitive cyclic manner, on when film advances and off when film stops, a switch means that selects or excludes the use of the pulser means for the operation of the film cleaner.

2. In an electrically operated film cleaner for removing dust, lint and static charge from the film, used in conjunction with a film printer and located adjacent to a film entrance to the film printer such that the film passes through the film cleaner before entering the film printer, said film cleaner having an upper jaw and a lower jaw, and between which there is a space for inserting the film, a device to activate the film cleaner the turns said cleaner ON and OFF in a regular periodic cycle when film is inserted into the space between the jaws and to deactivate the film cleaner to remain OFF when there is no film between the jaws comprising:

a pulser means, connected by circuitry means to a film advance mechanism of the film printer which produces a signal each time the film advances, said signal causing the pulse to turn the film cleaner ON for a short period as the film advances, and then to turn said cleaner, said period being set by an adjustment means such that the film cleaner operates to coincide with the regular stop and go motion of the film printer as the printer stops the film to print each individual frame and then advances and stops the film to print each subsequent frame in a repetitive cycle manner, ON when film advances, and OFF when film stops, a switch means that selects or excludes the use of the pulser means for the operation of the film cleaner.

* * * * *